US006539676B2

(12) United States Patent
Price

(10) Patent No.: US 6,539,676 B2
(45) Date of Patent: Apr. 1, 2003

(54) PORTABLE ROOF ANCHOR

(76) Inventor: Daniel W. Price, 1248 Robbin Dr., Port Orange, FL (US) 32119

( * ) Notice: Subject to any disclaimer, the term of this patent is extended or adjusted under 35 U.S.C. 154(b) by 0 days.

(21) Appl. No.: 09/922,400

(22) Filed: Aug. 3, 2001

(65) Prior Publication Data

US 2002/0014042 A1 Feb. 7, 2002

Related U.S. Application Data

(60) Provisional application No. 60/223,081, filed on Aug. 4, 2000.

(51) Int. Cl.[7] ..... E04G 3/10

(52) U.S. Cl. ..... 52/127.2; 52/127.5; 52/741.1; 52/749.12; 248/125.2; 182/145

(58) Field of Search ..... 52/127.1, 127.2, 52/127.5, 125.6, 698, 749.1, 749.12, 741.1; 248/125.2, 125.8, 297.11, 331, 332; 182/145, 142

(56) References Cited

U.S. PATENT DOCUMENTS

| | | | | | |
|---|---|---|---|---|---|
| 1,247,706 | A | * | 11/1917 | Moran | 182/145 |
| 4,004,778 | A | * | 1/1977 | Steinhagen | 182/142 |
| 4,421,242 | A | * | 12/1983 | Brueske | 104/245 |
| 4,801,117 | A | * | 1/1989 | Take | 182/142 |
| 4,817,758 | A | * | 4/1989 | Gilmore | 182/142 |
| 5,341,898 | A | * | 8/1994 | Baziuk | 182/142 |
| 5,498,011 | A | * | 3/1996 | Kilada et al. | 182/142 |
| 5,934,437 | A | * | 8/1999 | Anson et al. | 193/15 |

FOREIGN PATENT DOCUMENTS

| | | | | |
|---|---|---|---|---|
| AU | 221337 | * | 4/1959 | 182/142 |
| DE | 138693 | * | 11/1979 | 182/142 |
| SU | 1379429 | * | 3/1988 | 182/142 |

OTHER PUBLICATIONS

Advertisement for B.H. Rigging Distributors.
Advertisement of Little Boss, Finn's Corporation.
Advertisement for Skyhook. *American Window Cleaner*, May/Jun. 2001, p. 21.
Advertisement in Window Cleaning Supplies catalog. J. Racenstein & Co., Inc., 1996, pp. 57–60.
Catalog for Fitch Enterprises, LTD.

* cited by examiner

*Primary Examiner*—Carl D. Friedman
*Assistant Examiner*—Brian E. Glessner
(74) *Attorney, Agent, or Firm*—David G. Maire; Beusse Brownlee Bowdoin & Wolter, P.A.

(57) ABSTRACT

A portable roof anchor having a slidably adjustable beam member is supported at a pivot location near a line support end and at an opposed end by a rotatably attached self-leveling counterweights. A line wrapped onto the beam member may be used as a handle for carrying the beam member to a roof top, then used to support a person or equipment over a side of the building. The counterweights have a relatively small top cross-section and a relatively large bottom cross-section so that, for any given amount of weight, a relatively large bottom surface area and a relatively tall height from the rooftop will be provided. A handle is provided near a line-deployed center-of-gravity so that the roof anchor assembly may be easily maneuvered, while the line remains over the side of the building, with one hand on the handle and a second hand cradled underneath the beam member. An L-handle bolt/nut combination may be used to rotatably attach the counterweights to the beam member, and also to configure the unattached counterweights into an easily carried, balanced assembly. A parapet mounted portable roof anchor includes a step member and a hand hold to facilitate a person's movement off of and back onto the roof.

23 Claims, 3 Drawing Sheets

PORTABLE ROOF ANCHOR

This application claims benefit of the Aug. 4, 2000, filing date of U.S. provisional patent application No. 60/223,081.

FIELD OF THE INVENTION

This invention relates generally to the field of roof anchors for securing a line along a side of a structure, and in particular to such roof anchors that are small enough and light enough to be carried by one person.

BACKGROUND OF THE INVENTION

The maintenance of a modern high-rise building often necessitates men and/or machines being supported along the sides of the building for window cleaning, painting, inspection or repair activities. Some buildings have specially designed equipment and/or permanent tie-down locations associated with the building for supporting such activities. However, some buildings have no such accommodations, and special removable rigs must be delivered to the building each time such activities are performed.

Many types of roof rigs are known in the art for anchoring a line from the top of a building. Two such machines sold under the marks "Little Boss" and "Big Boss" by Finn's Corporation (www.finnsboss.com) are adjustable to accommodate parapet walls of varying sizes. These machines weigh at least 250 pounds and are moved about the building roof on wheels. Such systems are difficult to deliver to the roof top and difficult to maneuver around obstacles on a roof.

Another known roof rig sold under the mark "Skyhook" by Skyhook Systems (www.skyhooksystems.com) is a motorized rolling roof rig with computerized controls. Such systems are heavy, complicated and expensive.

The roof rig sold under the mark "MIO-250" by J. Racenstein & Co., Inc. (www.windocleaningsupplies.com) is designed to fold together into a reduced-size package for delivery to a job site. However, even when folded, this machine is large and heavy enough to need wheels for easy movement, and it has a shape that makes it virtually impossible for one man to carry. This machine weighs over 400 pounds with counterweights.

The roof rigs sold by B. H. Rigging Distributors were relatively simple in design and somewhat lighter than some other designs. However, these rigs are still difficult to maneuver around obstacles on a roof, and they have limited flexibility for accommodating the many different physical limitations that may be encountered on various roofs. This company has also sold roof rigs that have a generally U-shape and are designed to mount over a parapet wall. While these devices are light and easy to carry, it is difficult for a person who is suspended from such a device to return to the top of the roof.

Fitch-Enterprises Ltd. sells roof rigs that include optional extension pieces for increasing or decreasing the overall length of the device. For example, the machine sold under the mark "Fitch Horse" may be used with one standard eight foot beam length, or an additional eight foot extension may be added to achieve an overall length of sixteen feet. This limited degree of adjustment in the length of the device is not adequate to accommodate every roof condition. Furthermore, the device weighs 160 pounds without counterweights. An additional 200 pounds of counterweight must be attached prior to use, and it must be disassembled to fit into a standard elevator or through a roof hatchway.

SUMMARY OF THE INVENTION

Accordingly, there is a need for an improved portable roof anchor device that is light enough to be handled by one man, that is flexible enough to accommodate a large variety of space limitations, that can be easily maneuvered around obstacles on a roof, and that is relatively inexpensive to manufacture when compared to the prior art devices described above. A roof rig is needed that can accommodate a parapet wall, while at the same time making it easy for a user to rappel from a rooftop.

A portable anchor designed specifically for supporting a line along a side of a structure is described herein as including: a beam member having a line support end, a counterweight end, and a pivot location; a line support member attached to the beam member at a line support location proximate the line support end; a counterweight attached to the beam member at a counterweight location proximate the counterweight end; wherein the beam member is slidably extendible in length so that the distance from the counterweight location to the pivot location may be fixed at any of a plurality of lengths. The portable anchor may include: a hollow outer member and an inner member extending partially into the hollow outer member and slidably moveable therein to be fixed at any of the plurality of lengths. The portable anchor may be carried in a line-deployed configuration by a single person having one hand holding a handle on the counterweight side of a center of gravity of the assembly and a second hand cradling the beam member between the center of gravity location and the line support end.

The portable anchor may further include a pair of line storage members attached to the beam mechanism, so that when the line is wrapped around the line storage members, the line forms a handle for carrying the beam member.

The counterweight may have a generally triangular shape rotatably attached to the beam member proximate a corner of the generally triangular shape so that a flat side of the counterweight is self-leveling. The counterweight may further include: a weight member having a hole formed there through; a bolt member having a head end and having a threaded end opposed the head end, the bolt member adapted for passing through a hole formed in the beam member and through the hole formed in the weight member; a handle member attached to the head end of the bolt member; a spacer member attached to the bolt member a predetermined distance from the handle member, the spacer member adapted to space the weight member from the handle member when the bolt member is disposed through the hole formed in the weight member; and a nut adapted to thread onto the threaded end of the bolt member for urging the weight member toward the spacer member and for retaining the counterweight on the beam member.

Such a device may be used for supporting a line over an edge of a structure by: providing a beam member having a line support end and a counterweight end, the beam member comprising a hollow outer member and an inner member slidably extending at least partially into the hollow outer member and fixable at a plurality of positions for providing the beam member with a respective plurality of lengths; positioning the beam member on a top of a structure at a working location; adjusting the length of the beam member to a maximum length permitted by the working location; connecting a counterweight to the beam member proximate the counterweight end; connecting a line to the beam member proximate the line support end; supporting the beam member at a pivot location of the beam member between the line support end and the counterweight end; and dropping the line over an edge of the structure. The beam member will have a center of gravity location when in a line-deployed configuration with the line and the counterweight connected to the beam member, and the anchor may be moved about the roof by attaching a handle to the beam member at a location between the counterweight end and the center of gravity location so that the beam member may be carried in the line-deployed configuration by a person having one hand holding the handle and a second hand cradling the beam member between the center of gravity location and the line support end. The device may also be carried to the roof by: attaching a line storage member to the beam member; wrapping the line around the line storage member; and using the line as a handle to carry the beam member.

The counterweight may be provided to have a generally triangular shape and pivotally connected to the beam member so that the counterweight will self-level with a bottom edge of the generally triangular shape in a horizontal position. This may be accomplished by providing a hole in the counterweight and a hole in the beam member; providing a bolt member having a head end and having a threaded end opposed the head end, the bolt member adapted for passing through the hole formed in the beam member and through the hole formed in the counterweight; attaching a handle to the head end of the bolt member; attaching a spacer member to the bolt member a predetermined distance from the handle member, the spacer member adapted to space the weight member from the handle member when the bolt member is disposed through the hole formed in the weight member; and threading a nut onto the threaded end of the bolt member for urging the weight member toward the spacer member and for retaining the counterweight on the beam member. In this manner, the counterweight may be carried separately from the beam member by passing the threaded end of the bolt member through the hole formed in the counterweight and tightening the nut against the counterweight with the handle in a predetermined position relative to the counterweight so that the counterweight is balanced when carried by the handle.

A portable anchor for supporting a line along a side of a structure having a parapet is described herein as including: a generally U-shaped member comprising a horizontal member, an inner vertical member extending downward from the horizontal member, and an outer vertical member extending downward from the horizontal member on a side of the horizontal member opposed the inner vertical member, the generally U-shaped member adapted to fit over a parapet; a step member attached to the outer vertical member and extending away from the outer vertical member; and a hand hold attached to the outer vertical member. The hand hold may include a bottom end attached to the outer vertical member at an angle of less than ninety degrees so that a line passing through the opening will be drawn against the outer vertical member.

DETAILED DESCRIPTION OF THE INVENTION

Figure 1:
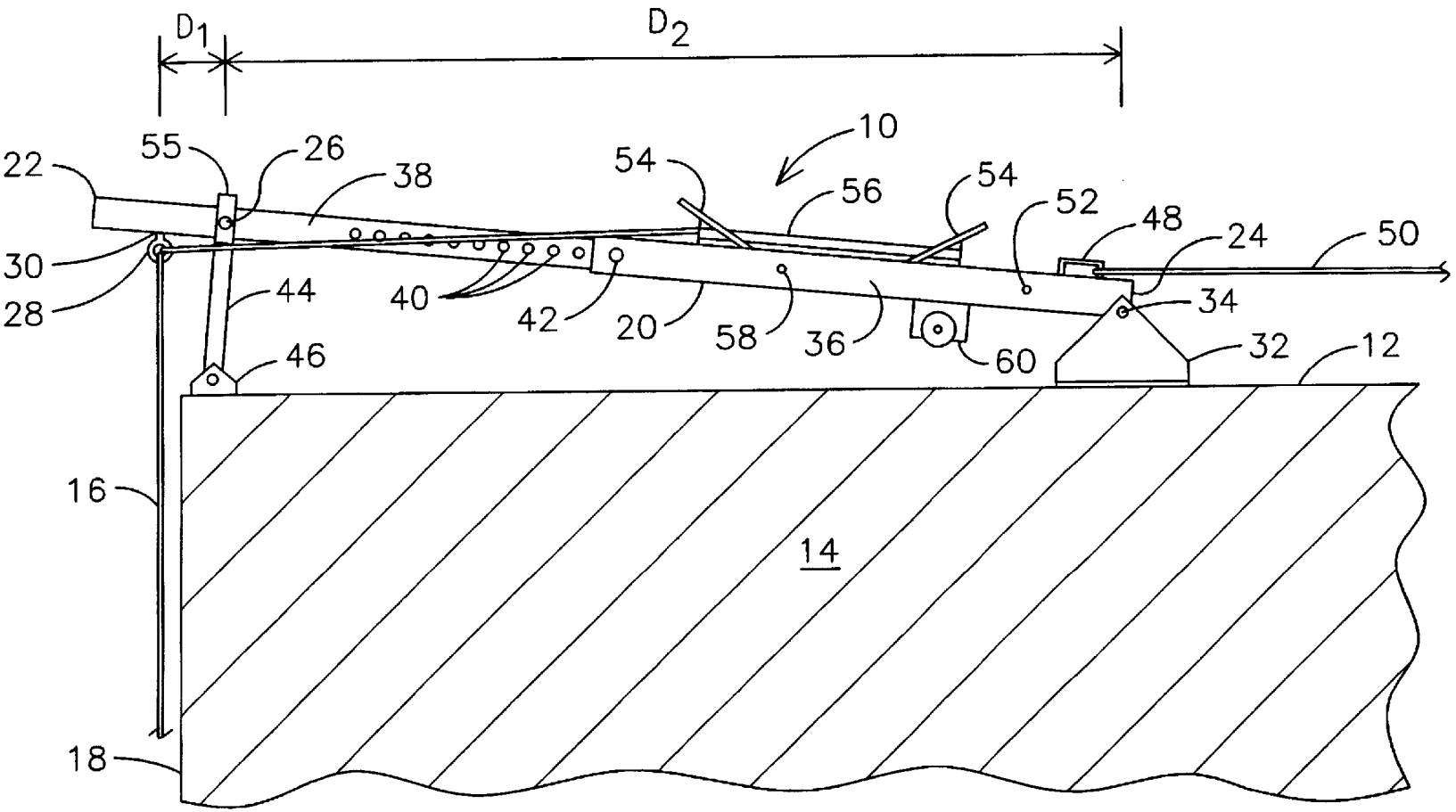
FIG. 1 is a side view of a portable roof anchor installed on a roof of a building.

FIG. 1 illustrates one embodiment of a portable roof anchor 10 installed on the top of a structure, here the flat roof 12 of a building 14. The portable roof anchor 10 may be used for supporting a line 16 along a vertical side 18 of the building 14, such as for cleaning the exterior of the windows of the building or for performing other maintenance activities along the vertical side 18 of the structure. The line may be a cable, rope, wire or other load carrying material as may be used for suspending a machine or person along the side 18 of the building 14.

Roof anchor 10 includes a beam member 20. Beam member 20 is illustrated as a linear-shaped structure having a line support end 22, a counterweight end 24, and a pivot location 26. Beam member 20 may have any desired cross-sectional shape for carrying bending moment loads, such as an I-beam, tube, bar or channel, for example. Beam member 20 may be formed of any metal, alloy or composite material and is preferably formed of a material having a high strength-to-weight ratio in order to improve the portability of the device. The cross-section of the beam member 20 may be different at different points along the length of the beam member 20. For example, to increase the lifting capability of the device for rescue applications, it may be necessary to form at least a portion of the beam member near the pivot location, where the bending moments will be the highest, from a solid bar of material, while a portion of the beam member having a lower level of stress may be formed from an open channel material.

A line support member 28 is attached to beam member 20 at a line support location 30 proximate the line support end 22. Line support member 28 may be a turnbuckle, hook, or a groove or notch formed in the beam member 20. Alternatively, line 16 may simply be tied or wrapped around beam member 20 at line support location 30 depending upon the safety requirements of a particular application. Line support location 30 is located a distance $D_1$ from pivot location 26 along the length of beam member 20. A counterweight 32 is attached to the beam member 20 at a counterweight location 34 located a distance $D_2$ from pivot location 26. Beam member 20 may be supported at pivot location 26 so that the downward force exerted on the line support member 28 is counterbalanced by the downward force exerted by the counterweight 32. The greater the mechanical advantage provided by the ratio of $D_2/D_1$, the smaller the mass of the counterweight 32 must be in order to counterbalance a given line load. The ratio of $D_2/D_1$ is selected so that when the beam member 20 is vertically supported at the pivot location 26, the moment of inertia about the pivot location 26 created by the counterweight 32 will exceed the moment of inertia about the pivot location 26 created by a line 16 connected to the line support member 28 by a predetermined safety margin; for example, a 4:1 safety margin.

In a preferred embodiment, beam member 20 is formed to be expandable along its length dimension so that it may be carried to the roof 12 of a building 14 in one configuration having a first shorter length, then reconfigured while on the roof 12 to a second configuration having a greater length. In this manner, beam member 20 may be more conveniently carried through stairways, elevators or other roof access openings without being disassembled. In the embodiment of FIG. 1, beam member 20 includes a hollow outer member 36 and an inner member 38 slidably extending partially into the hollow outer member 36. A plurality of holes 40 are formed at various locations on the inner member 38 so that a removable connector, such a bolt 42 and mating nut (not shown) may be used to lock the two portions of the beam member 20 together to have a selected length $D_2$. The ratio of $D_2/D_1$ may thus be varied, for example from 20:1 to 40:1. In this manner, portable anchor 10 may be used in a variety of locations, some of which do not provide sufficient space for the extension of beam member 20 to its full length. Furthermore, beam member 20 may be delivered to the roof 12 in a first configuration having its shortest length to simplify the delivery process, then reconfigured to a desired second length. To compensate for any reduction in length $D_2$ necessary to accommodate a job-specific physical interference, a corresponding increase in the weight of counterweight 32 or a reduction in the line load may be provided.

The vertical support of beam member 20 may be provided by a bipod 44 having a ladder-style support foot 46 pivotally connected to each leg. Bipod 44 is connected to beam member 20 at pivot location 26 by any known type of mechanical connection, and preferably a connection providing at least some horizontal support between the two structures 20, 44. Furthermore, vertical support member 44 should be restrained from rotating with respect to beam member 20 about pivot location 26 in order to prevent the roof anchor 10 from collapsing, thereby presenting an unsafe situation.

A handle 48 may be attached to beam member 20 for carrying of the device. Handle 48 may also function as a location for connecting a safety line 50 to the roof anchor 10. The handle 48 is preferably located a short distance toward the counterweight end 24 from a line-deployed center of gravity location 52. In one embodiment, this distance may be approximately 12–18 inches. In this manner, a single person may easily lift and move the roof anchor 10 with the attached counterweight 32 and deployed line 16 by placing one hand on the handle 48, and by cradling the beam member 20 with the other hand positioned at a location between the center of gravity 52 and the line support end 22. By using such a strategically located handle, the operator is able to easily lift, tilt and turn the roof anchor assembly 10 in its deployed configuration with the line 16 over the side 18 of the building 12 in order to move from place to place while avoiding any obstacle on the roof. For example, lightning rods are commonly mounted to a parapet on a corner of a building. With prior art roof rigs, it was necessary to retrieve the entire line in order to move from one side of a lightning rod to another, since such rigs were too heavy or bulky to be lifted. In one embodiment, the portable roof anchor of FIG. 1 with 300 feet of 7/16 inch nylon mountain-climbing rope and counterweights attached may weigh only about ninety pounds. One person lifting the device 10 with one hand on handle 48 and one hand cradling under the beam member 20 can easily tilt the line supporting end 22 upward to clear a lightning rod with the line 16 fully deployed. Similarly, an operator can step over or around obstacles on the roof 12 which would be difficult to maneuver around with a prior art wheeled device.

A line storage member such as brackets 54 may also be attached to beam member 20. Line 16 may be wrapped around the brackets 54 for transport, and may be securely tied or otherwise affixed to brackets 54 when in use for supporting a load along a side 18 of building 14. Other styles of line storage members may be used, such as a single unit having two opposed raised members for wrapping the line 16. Furthermore, when line 16 is wrapped around the line storage member, the line itself may serve as a handle or shoulder pad 56 for carrying the device. By spacing brackets 54 apart and on either side of a center of gravity 58 of the device in its line-stored configuration with the counterweight 32 removed, the line handle 56 may be held with one hand or two, or it may be slung over the shoulder of the person carrying the device to and from a roof 12.

Counterweight 32 may be a single weight member or a plurality of individual weight members. Counterweight 32 is connected to beam member 20 at or very close to the counterweight end 24 in order to maximize dimension $D_2$. Unlike prior art devices, roof anchor 10 advantageously uses the counterweight 32 as a foot for resting on the roof 12, thereby eliminating the cost and weight associated with a separate foot/wheel structure at the counterweight end 24. Counterweight 32 may preferably have a bottom portion cross-sectional area that is greater than a top portion cross-sectional area, such as the generally triangular shape as seen from perspective of the side elevation view of FIG. 1. Other such shapes include a half-moon shape and an inverted T-shape as viewed from a side perspective. By rotatably connecting the counterweight 32 to the beam member 20 within its top portion, the counterweight 32 becomes self-leveling with the relatively larger flat bottom surface being horizontal no matter what angle the beam member 20 has to the horizon. Because the counterweight 32 rests directly on the roof 12, this advantageously provides a large, flat bottom surface to reduce the weight per unit area exerted on the roof 12. This structure also provides a relatively taller counterweight 32, which may be advantageous if it becomes desirable to have a winch 60 or other device mounted on the bottom of beam member 20. This type of counterweight shape also provides a very stable base for resting the portable anchor 10 on the roof 12.

Figure 2:
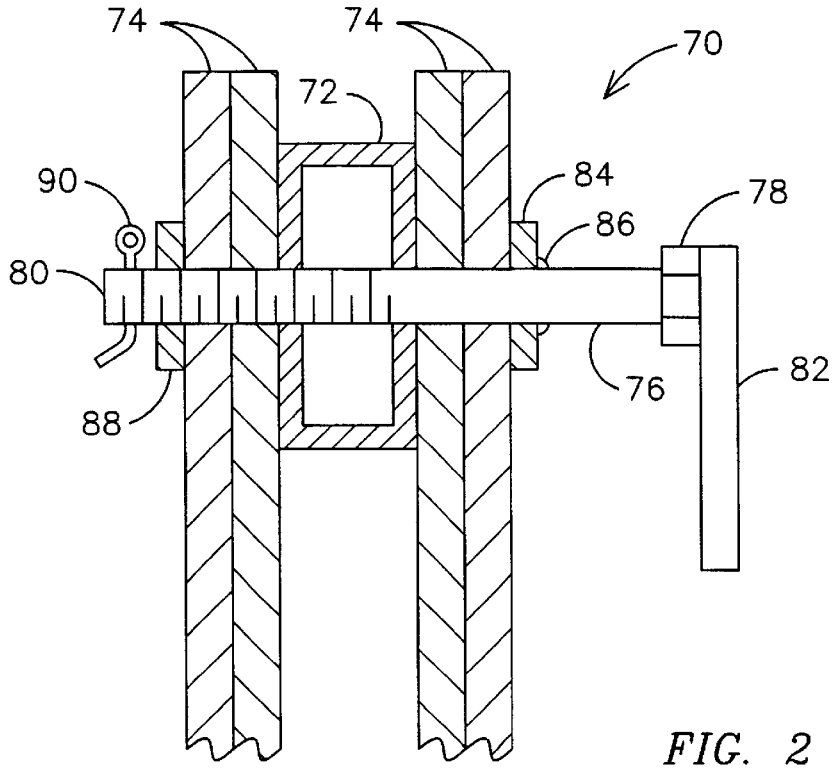
FIG. 2 is a partial rear cross-sectional view of a counterweight assembly rotatably attached to a beam member by an L-handle bolt and nut combination.

FIG. 2 illustrates a partial rear cross-sectional view of a counterweight assembly 70 installed on a beam member 72. The counterweight assembly 70 includes four individual weight members 74 rotatably attached to the beam member 72 in a top portion of the half-moon shape. Additional weight members may be used if necessary to carry a heavier load or to compensate for a shorter beam length. A bolt member 76 having a head end 78 and having a threaded end 80 opposed the head end 78 passes through holes formed in the weight members 74 and the beam member 72. A handle member, such as L-handle 82 is attached to the head end 78, such as by welding a bar to a standard bolt. A spacer member such as washer 84 is attached by weld 86 to bolt member 76 at a predetermined distance from the handle member 82. Spacer member 84 functions to space the weight members 74 away from the handle member 82 when nut 88 is threaded onto bolt member 76 to urge the weight members 74 toward the spacer member 84. A retainer device such as pin 90 may be used to ensure that the nut 88 does not become unintentionally disengaged from bolt member 76. By only tightening nut 88 to a finger tight condition, the weight members 74 are free to self-level as beam member 72 is moved about.

Figure 3A:
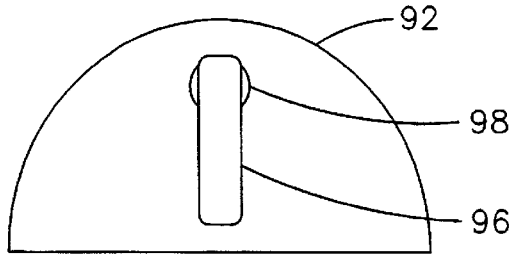
FIG. 3A is a top view of a half-moon shaped counterweight configured to be carried by an L-handle bolt and nut combination.
Figure 3B:
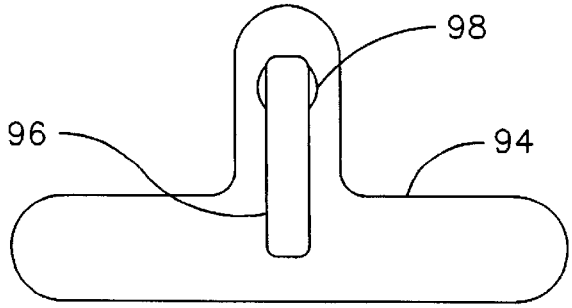
FIG. 3B is a top view of a T-shaped shaped counterweight configured to be carried by an L-handle bolt and nut combination.

When transporting the weight members 74 to the top of a structure 14, they may be removed from the beam member 72, installed on the bolt member 76, and tightened firmly against spacer member 84 by nut 88. FIGS. 3A and 3B are top views of a stack of half-moon shaped counterweight members 92 and a T-shaped counterweight members 94, respectively, in a transportation configuration having an L-handle 96 attached by a bolt member (not visible) to a spacer member 98 and tightened against the counterweights by a nut (not visible). By positioning and tightening the L-handle 96 over a center-of-gravity of the stack of counterweight members 92, 94, the entire group of counterweight members may be balanced and carried with one hand.

In one embodiment, beam member 20 includes a 2½ inch square, high strength aluminum alloy tube with a wall thickness of 0.125 inch as the outer member 36 and a mating inner member having a wall thickness of 0.1875 inch. A standard 2 inch turnbuckle 28 is attached to the inner tube approximately 3 inches ($D_1$) from the pivot location 26. The overall length of the beam member 20 may be adjusted by sliding the inner member 38 into the outer member 36 to obtain a $D_2$ dimension ranging from about 5 feet to 10 feet in 6 inch increments, thus providing a ratio of $D_2$:$D_1$ of about 20:1 to 40:1. A plurality of counterweights 32 may be connected to the beam member 20 to provide a desired load supporting capability. The counterweights may be steel plate, each weighing about 11 pounds. The bipod 44 may be formed to include a top pair of opposed angle brackets 54 which together define a channel into which the inner tube 38 may be placed and affixed. The bipod 44 may support the beam member 20 about 17½ inches above the rooftop 12. The total weight of such an assembly, including 46 pounds of counterweight and 300 feet of 7/16 inch diameter nylon line would be about 92 pounds, light enough to be conveniently handled by one person. The counterweights may be removed from the beam and carried separately, then reassembled on the rooftop 12 at a working location. The length of the beam assembly 20 may then be adjusted to a maximum length permitted by any obstructions present at the working location.

Not all building roofs are flat. The roof anchor 10 can also be used on a peaked roof by positioning the bipod feet 46 on one side of the roof, at or very near to the peak of the roof. The line 16 would then be routed along the opposite side of the roof and over the side of the building. The line load would then be transferred to the beam member 20 and resisted by the bipod support 44 in much the same manner as described above, but with the axis of the loads being rotated from horizontal/vertical by the angle of the roof. The portable roof anchor 10 may also be used on a roof having a parapet by placing the bipod feet 46 on the top of the parapet, or by providing a bipod 44 having sufficient height to clear the beam member 20 over the parapet. Alternatively, the device may be used without a bipod 44 by laying the beam member directly onto the parapet at the pivot location 26, or with different bipod heights to accommodate varying parapet wall heights.

Figure 4:
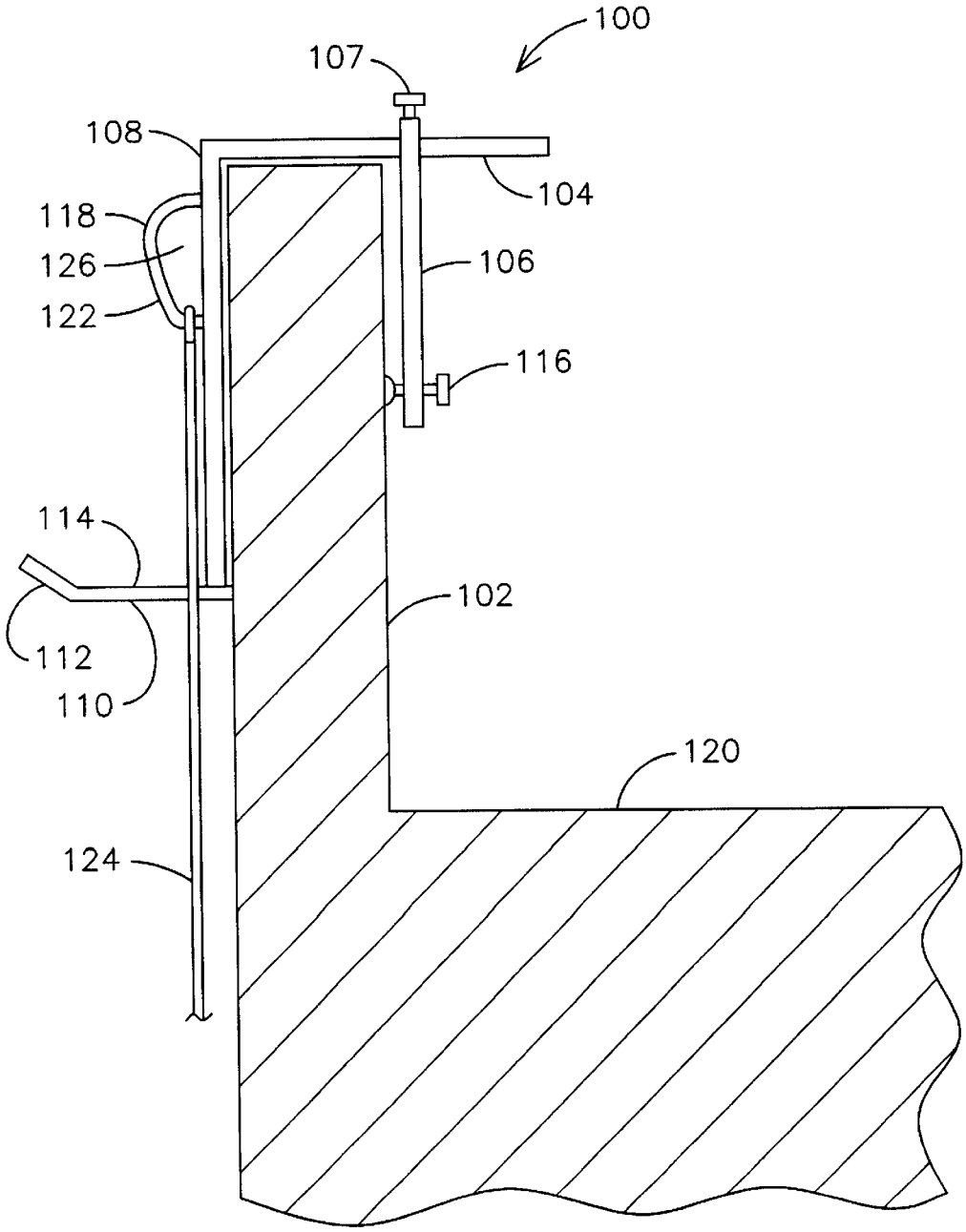
FIG. 4 is a side view of a portable roof anchor installed on a roof of a building having a parapet.

One skilled in the art may appreciate that when using a portable roof anchor, it is difficult to step over the edge of the building and to step back onto the roof while being supported only by a tie line. These maneuvers are made even more difficult on roofs having a parapet. Accordingly, a portable roof anchor 100 is illustrated in FIG. 4 as installed over a parapet wall 102. The portable anchor 100 is a generally U-shaped member having a horizontal member 104, an inner vertical member 106 extending downward from the horizontal member 104, and an outer vertical member 108 extending downward from the horizontal member 104 on a side of the horizontal member 104 opposed the inner vertical member 106. There may be an adjustable connection 107 between the horizontal member 104 and at least one of the inner vertical member 106 and outer vertical member 108 to adapt the device to fit over parapets 102 having a plurality of widths. Advantageously, the anchor 100 also includes a step member 110 attached to the outer vertical member 108 and extending in a generally horizontal direction away from the outer vertical member 108. The step member 110 may include an end 112 opposed the generally U-shaped member 100 being angled upward from horizontal to serve as a foot stop. A top surface 114 of the step member 100 may have a non-slip coating or surface finish of any type known in the art. An adjustable wall stop 116 may be connected to the inner vertical member 106 opposed the horizontal member 104 for securing the generally U-shaped member 100 against the parapet 102. A hand hold 118 is attached to the outer vertical member 108 to provide a convenient location for a user to hold onto the portable roof anchor 100 while standing on the step member 110 and while moving onto and off of the roof surface 120. The hand hold 118 has a bottom end 122 attached to the outer vertical member 108 at an angle of less than ninety degrees, for example 20 degrees, so that a line 124 passing through the opening 126 formed by the hand hold 122 will be drawn against the outer vertical member 108. The portable roof anchor 100 can be easily carried to the roof surface 120 by one person, adjusted to accommodate any width of parapet 102, for example up to 15 inches in width, then installed at any desired working location. The user makes an attachment to the line 124, then while holding onto handhold 122, steps over the parapet 102 onto step member 110 before rappelling down the side of the building. Upon returning to the rooftop 120, the user may use the handhold 122 while stepping on the step member 110 for an easy return over the parapet 102.

While the invention has been described herein with reference to particular embodiments, it will be understood by those skilled in the art that various changes may be made and various equivalents may be substituted for elements thereof without departing from the scope of the invention. Therefore, it is intended that the invention not be limited to the particular embodiments disclosed herein, but that the invention will include all embodiments falling within the scope of the appended claims.

I claim as my invention:

1. A portable anchor for supporting a line along a side of a structure, the portable anchor comprising:

a beam member having a line support end, a counterweight end, and a pivot location;

a line support member attached to the beam member at a line support location proximate the line support end; and a counterweight rotatably attached to the beam member at a counterweight location proximate the counterweight end, the counterweight rotatable to have a self-leveling bottom surface for resting on a surface of a structure.

2. The portable anchor of claim 1, wherein the beam member comprises a hollow outer member and an inner member extending at least partially into the hollow outer member and slidably moveable therein to provide the beam member with any of a plurality of lengths.

3. The portable anchor of claim 1, further comprising a bipod removably attached to the beam member at the pivot location.

4. The portable anchor of claim 1, wherein the portable anchor has a center of gravity location when in a line-deployed configuration with a line supported from the line support member, and further comprising a handle attached to the beam member at a location proximate to but not directly at the center of gravity location so that the portable anchor may be carried in a line-deployed configuration by a person having one hand holding the handle and a second hand cradling the beam member on a side of the center of gravity opposed the handle.

5. The portable anchor of claim 1, further comprising a line storage member attached to the beam member, the line storage member comprising spaced apart members for wrapping a line, the line forming a handle for carrying the beam member when wrapped on the line storage member.

6. The portable anchor of claim 1, wherein the counterweight comprises a bottom portion cross-sectional area that is greater than a top portion cross-sectional area.

7. The portable anchor of claim 6, wherein the counterweight has a generally triangular shape from a side perspective.

8. The portable anchor of claim 6, wherein the counterweight has a generally half-moon shape from a side perspective.

9. The portable anchor of claim 6, wherein the counterweight has a generally inverted T-shape from a side perspective.

10. A portable anchor for supporting a line along a side of a structure, the portable anchor comprising:

a beam member having a line support end, a counterweight end, and a pivot location;

a line support member attached to the beam member at a line support location proximate the line support end;

a counterweight attached to the beam member at a counterweight location proximate the counterweight end;

wherein the beam member is slidably extendible in length so that the distance from the counterweight location to the pivot location may fixed at any of a plurality of lengths;

wherein the counterweight further comprises:

a weight member having a hole formed there through;

a bolt member having a head end and having a threaded end opposed the head end, the bolt member adapted for passing through a hole formed in the beam member and through the hole formed in the weight member;

a handle member attached to the head end of the bolt member;

a spacer member attached to the bolt member a predetermined distance from the handle member, the spacer member adapted to space the weight member from the handle member when the bolt member is disposed through the hole formed in the weight member;

a nut adapted to thread onto the threaded end of the bolt member for urging the weight member toward the spacer member and for retaining the counterweight on the beam member.

11. A portable anchor for supporting a line along a side of a structure, the portable anchor comprising:

a beam member having a line support end, a counterweight end, and a pivot location;

a line attached to the beam member proximate the line support end;

a pivot support member having a beam end attached to the beam member at the pivot location and having a foot end opposed the beam end;

a counterweight having a top portion pivotally attached to the beam member proximate the counterweight end and having a bottom surface that is self-leveling to horizontal by rotation of the counterweight relative to the beam member;

wherein when the portable anchor is positioned on a top of a structure for supporting the line along a side of the structure, the foot end of the pivot support member and the bottom surface of the counterweight are in contact with the top of the structure.

12. The portable anchor of claim 11, wherein the cross-sectional area of the bottom portion of the counterweight is greater than the cross-sectional area of the top portion of the counterweight.

13. The portable anchor of claim 12, wherein the counterweight has a generally triangular shape from a side perspective.

14. The portable anchor of claim 12, wherein the counterweight has a generally half-moon shape from a side perspective.

15. The portable anchor of claim 12, wherein the counterweight has a generally inverted T-shape from a side perspective.

16. The portable anchor of claim 11, wherein the beam member comprises a hollow outer member and an inner member extending at least partially into the hollow outer member and slidably moveable therein to provide the beam member with any of a plurality of lengths.

17. The portable anchor of claim 11, wherein the portable anchor has a center of gravity location when in a line-deployed configuration, and further comprising a handle attached to the beam member at a location proximate to but not directly at the center of gravity location so that the portable anchor may be carried in the line-deployed configuration by a person having one hand holding the handle and a second hand cradling the beam member on a side of the center of gravity location opposed the handle.

18. The portable anchor of claim 11, further comprising a line storage member attached to the beam member, the line storage member comprising spaced apart members for wrapping a line, the wrapped line forming a handle for carrying the beam member when stored on the line storage member.

19. A method of supporting a line over an edge of a structure, the method comprising:

providing a beam member having a line support end and a counterweight end, the beam member comprising a hollow outer member and an inner member slidably extending at least partially into the hollow outer member and fixable at a plurality of positions for providing the beam member with a respective plurality of lengths;

positioning the beam member on a top of a structure at a working location;

adjusting the length of the beam member to a maximum length permitted by the working location;

rotatably connecting a counterweight to the beam member proximate the counterweight end so that a bottom surface of the counterweight is self-leveling to horizontal;

connecting a line to the beam member proximate the line support end;

supporting the beam member at a pivot location of the beam member between the line support end and the counterweight end;

allowing the self-leveled counterweight bottom surface to rest on the top of the structure; and dropping the line over an edge of the structure.

20. The method of claim 19, wherein the beam member has a center of gravity location when in a line-deployed configuration with the line and the counterweight connected to the beam member, and further comprising:

attaching a handle to the beam member at a location proximate to but not directly at the center of gravity location so that the beam member may be carried in the line-deployed configuration by a person having one hand holding the handle and a second hand cradling the beam member on a side of the center of gravity location opposed the handle.

21. The method of claim 19, further comprising:

attaching a line storage member to the beam member;

wrapping multiple loops of the line around the line storage member; and using the wrapped line as a handle to carry the beam member.

22. A method of supporting a line over an edge of a structure, the method comprising:

providing a beam member having a line support end and a counterweight end, the beam member comprising a hollow outer member and an inner member slidably extending at least partially into the hollow outer member and fixable at a plurality of positions for providing the beam member with a respective plurality of lengths;

positioning the beam member on a top of a structure at a working location;

adjusting the length of the beam member to a maximum length permitted by the working location;

connecting a counterweight to the beam member proximate the counterweight end;

connecting a line to the beam member proximate the line support end;

supporting the beam member at a pivot location of the beam member between the line support end and the counterweight end;

allowing the counterweight to rest on the top of the structure; and dropping the line over an edge of the structure;

further comprising attaching the counterweight to the beam member by:

providing a hole in the counterweight and a hole in the beam member;

providing a bolt member having a head end and having a threaded end opposed the head end, the bolt member adapted for passing through the hole formed in the beam member and through the hole formed in the counterweight;

attaching a handle to the head end of the bolt member;

attaching a spacer member to the bolt member a predetermined distance from the handle member, the spacer member adapted to space the weight member from the handle member when the bolt member is disposed through the hole formed in the weight member; and threading a nut onto the threaded end of the bolt member for urging the weight member toward the spacer member and for retaining the counterweight on the beam member.

23. The method of claim 22, further comprising carrying the counterweigh separately from the beam member by:

passing the threaded end of the bolt member through the hole formed in the counterweight; and tightening the nut against the counterweight with the handle in a predetermined position relative to the counterweight so that the counterweight is balanced when carried by the handle.

* * * * *